US008241102B2

(12) United States Patent
Kanellos et al.

(10) Patent No.: US 8,241,102 B2
(45) Date of Patent: Aug. 14, 2012

(54) GAMING SYSTEM HAVING DYNAMIC SYMBOL GENERATION

(75) Inventors: Kurt J. Kanellos, Naperville, IL (US); Jeremy M. Hornik, Chicago, IL (US); Robert A. Rissetto, Elk Grove Village, IL (US)

(73) Assignee: WMS Gaming Inc., Waukegan, IL (US)

( * ) Notice: Subject to any disclaimer, the term of this patent is extended or adjusted under 35 U.S.C. 154(b) by 554 days.

(21) Appl. No.: 12/434,941

(22) Filed: May 4, 2009

(65) Prior Publication Data

US 2009/0312086 A1 Dec. 17, 2009

Related U.S. Application Data

(60) Provisional application No. 61/131,853, filed on Jun. 12, 2008.

(51) Int. Cl.
*A63F 9/24* (2006.01)

(52) U.S. Cl. ..... 463/17; 463/20; 463/30; 463/31

(58) Field of Classification Search ..... 463/19, 463/20, 17, 30, 31
See application file for complete search history.

(56) References Cited

U.S. PATENT DOCUMENTS 5,257,784 A 11/1993 Boylan et al.
5,655,965 A 8/1997 Takemoto et al.
6,120,378 A 9/2000 Moody et al.
6,123,333 A 9/2000 McGinnis, Sr. et al.
6,471,208 B2 10/2002 Yoseloff et al.
6,517,433 B2 2/2003 Loose et al.
6,769,986 B2 8/2004 Vancura
7,160,187 B2 1/2007 Loose et al.
7,585,219 B2 * 9/2009 Randall et al. ..... 463/20
2005/0059470 A1 * 3/2005 Cannon ..... 463/19
2006/0040721 A1 * 2/2006 Cuddy et al. ..... 463/16
2006/0058097 A1 3/2006 Berman et al.
2006/0246977 A1 * 11/2006 Cannon ..... 463/13

FOREIGN PATENT DOCUMENTS

WO WO 2007/130444 A1 11/2007

OTHER PUBLICATIONS

"Game On! Online Fruit Machine at Spin Palace!" from website http://www.spinpalace.com/uk/fruit-machines/game-on.asp; printed from website Apr. 19, 2009 (2 pages).

* cited by examiner

*Primary Examiner* — Ronald Laneau
*Assistant Examiner* — Wilner Jean Baptiste
(74) *Attorney, Agent, or Firm* — Nixon Peabody LLP

(57) ABSTRACT

A method of playing a wagering game comprises displaying on at least one display a first plurality of symbols located in an evaluation location, and repeatedly generating a plurality of replacement symbols at a symbol generation point on the at least one display. The method further comprises causing the plurality of replacement symbols to travel from the symbol generation point to the evaluation location along a symbol path, replacing at least one of the first plurality of symbols with at least one of the replacement symbols arriving at the evaluation location, and paying an award for a winning combination of symbols in the evaluation location.

29 Claims, 14 Drawing Sheets

GAMING SYSTEM HAVING DYNAMIC SYMBOL GENERATION

CROSS-REFERENCE TO RELATED APPLICATION

This application claims the benefit of U.S. Provisional Application Ser. No. 61/131,853, filed Jun. 12, 2008, entitled "Gaming System Having Dynamic Symbol Generation."

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, and methods for playing wagering games, and more particularly, to gaming systems having dynamic symbol generation.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

To increase appeal, some gaming terminals may display a plurality of wagering games to offer greater opportunities for winning awards. One way to further excitement and entertainment value of such gaming terminals is to provide a wagering games having interesting geometric configurations and animations along with accompanying music.

SUMMARY OF THE INVENTION

According to one aspect of the present invention, a method of playing a wagering game comprises displaying on at least one display a first plurality of symbols located in an evaluation location, and repeatedly generating a plurality of replacement symbols at a symbol generation point on the at least one display. The method further comprises causing the plurality of replacement symbols to travel from the symbol generation point to the evaluation location along a symbol path, replacing at least one of the first plurality of symbols with at least one of the replacement symbols arriving at the evaluation location, and paying an award for a winning combination of symbols in the evaluation location.

According to another aspect of the invention, a gaming system comprises a wager input device, at least one gaming terminal including at least one display, and at least one controller. The at least one controller is operative to (i) cause the at least one display to display a first plurality of symbols located in an evaluation location, (ii) repeatedly generate a plurality of replacement symbols at a symbol generation point on the at least one display, (iii) cause the plurality of replacement symbols to travel from the symbol generation point to the evaluation location along a symbol path, (iv) replace at least one of the first plurality of symbols with at least one of the replacement symbols arriving at the evaluation location, and (v) pay an award for a winning combination of symbols in the evaluation location.

According to yet another aspect of the invention, a method of playing a wagering game comprises receiving a player selection of a wager size selected from a plurality of available wager sizes, displaying on at least one display a first plurality of symbols located in an evaluation location and repeatedly generating a plurality of replacement symbols at a symbol generation point on the at least one display. The method further comprises causing the plurality of replacement symbols to travel from the symbol generation point to the evaluation location along a symbol path, replacing at least one of the first plurality of symbols with at least one of the replacement symbols, playing a song while the replacement symbols are generated, and paying an award for a winning combination of symbols in the evaluation location.

According to yet another aspect of the invention, a method of playing a wagering game comprises displaying on at least one display an evaluation location comprising an array of evaluation positions, receiving a wager, and generating a first quantity of symbols at a symbol generation point on the at least one display. The method further comprises causing each of the generated symbols to travel from the symbol generation point to a selected evaluation position in the array, and paying an award for a winning combination of symbols in the evaluation location.

According to yet another aspect of the invention, one or more computer readable storage media is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

Figure 1A:
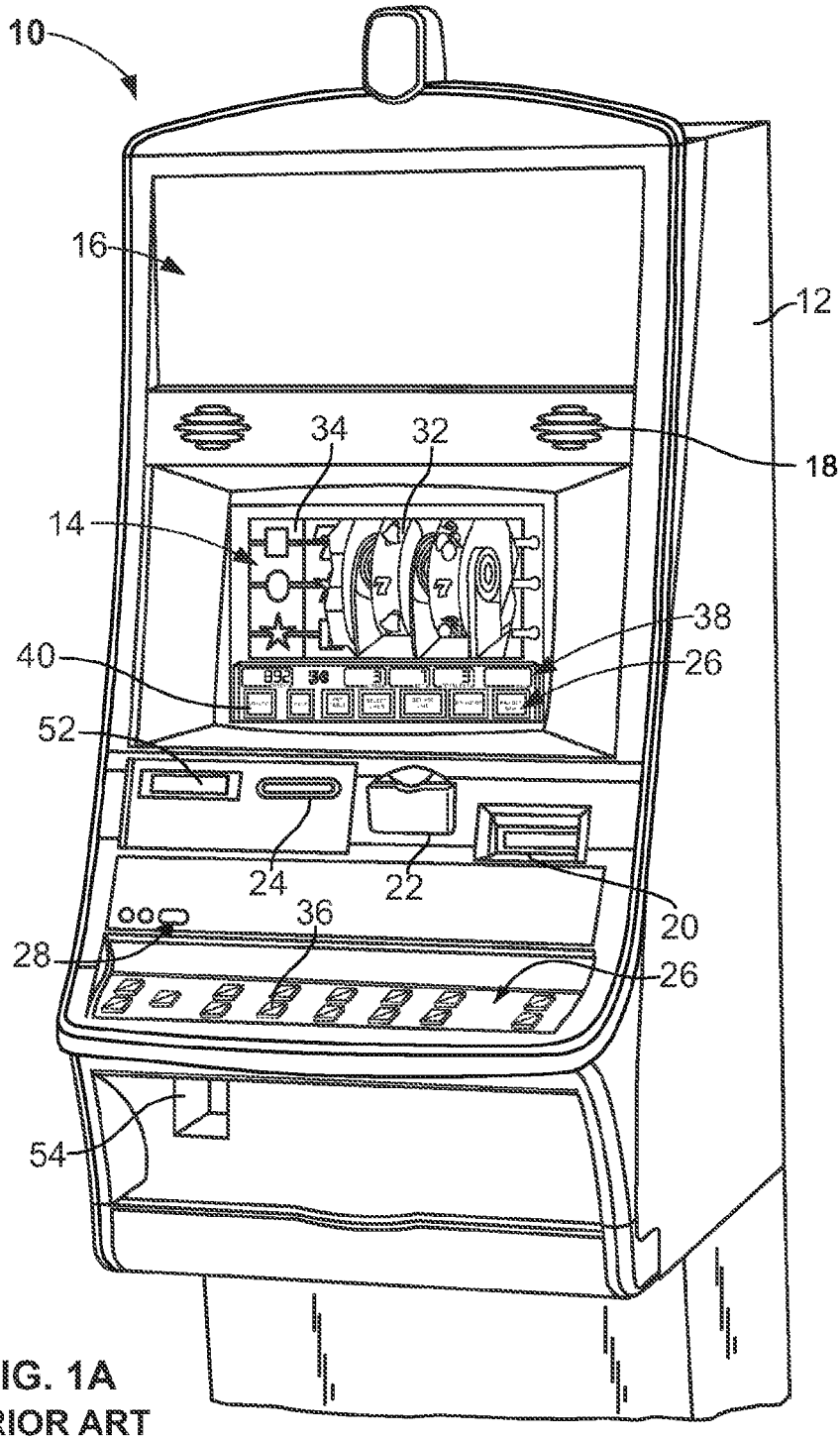
FIG. 1A PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
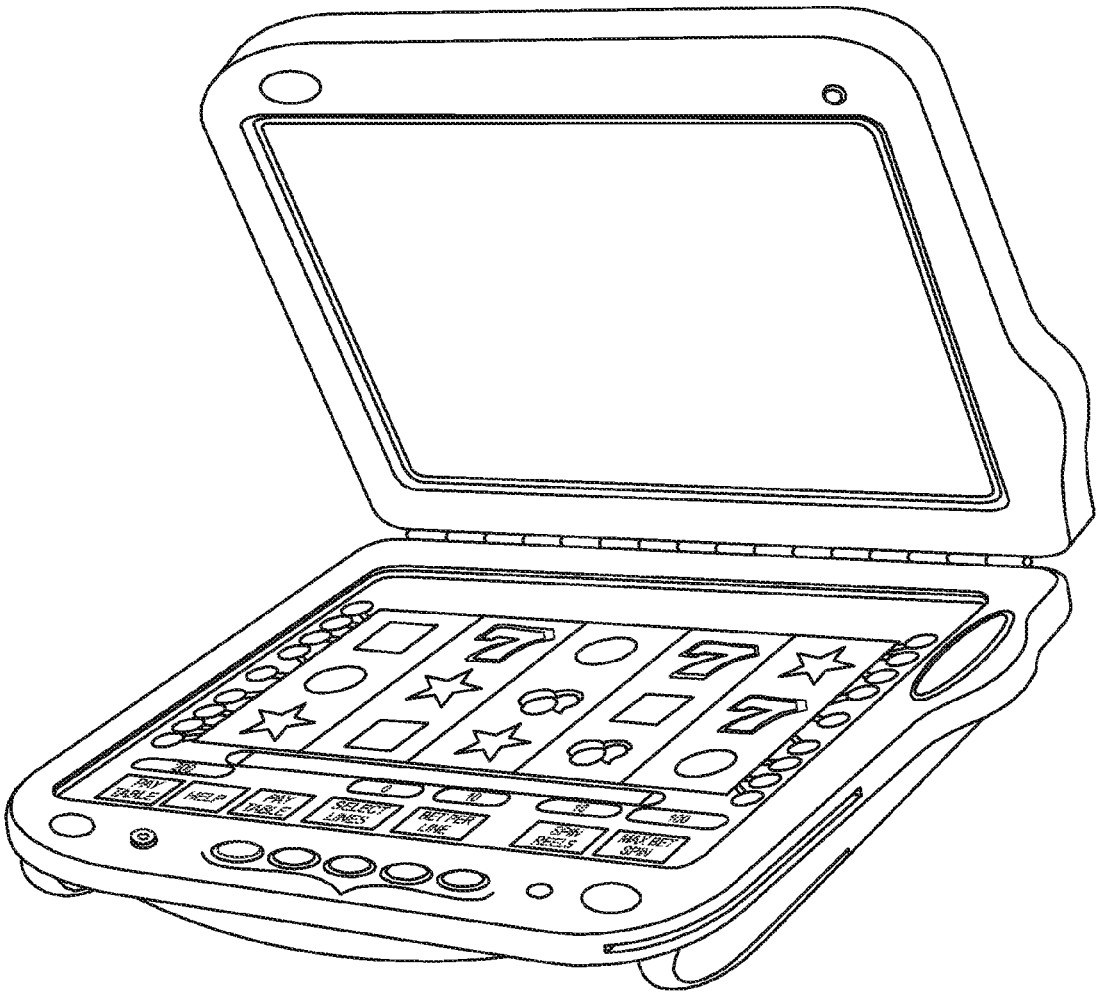
FIG. 1B PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
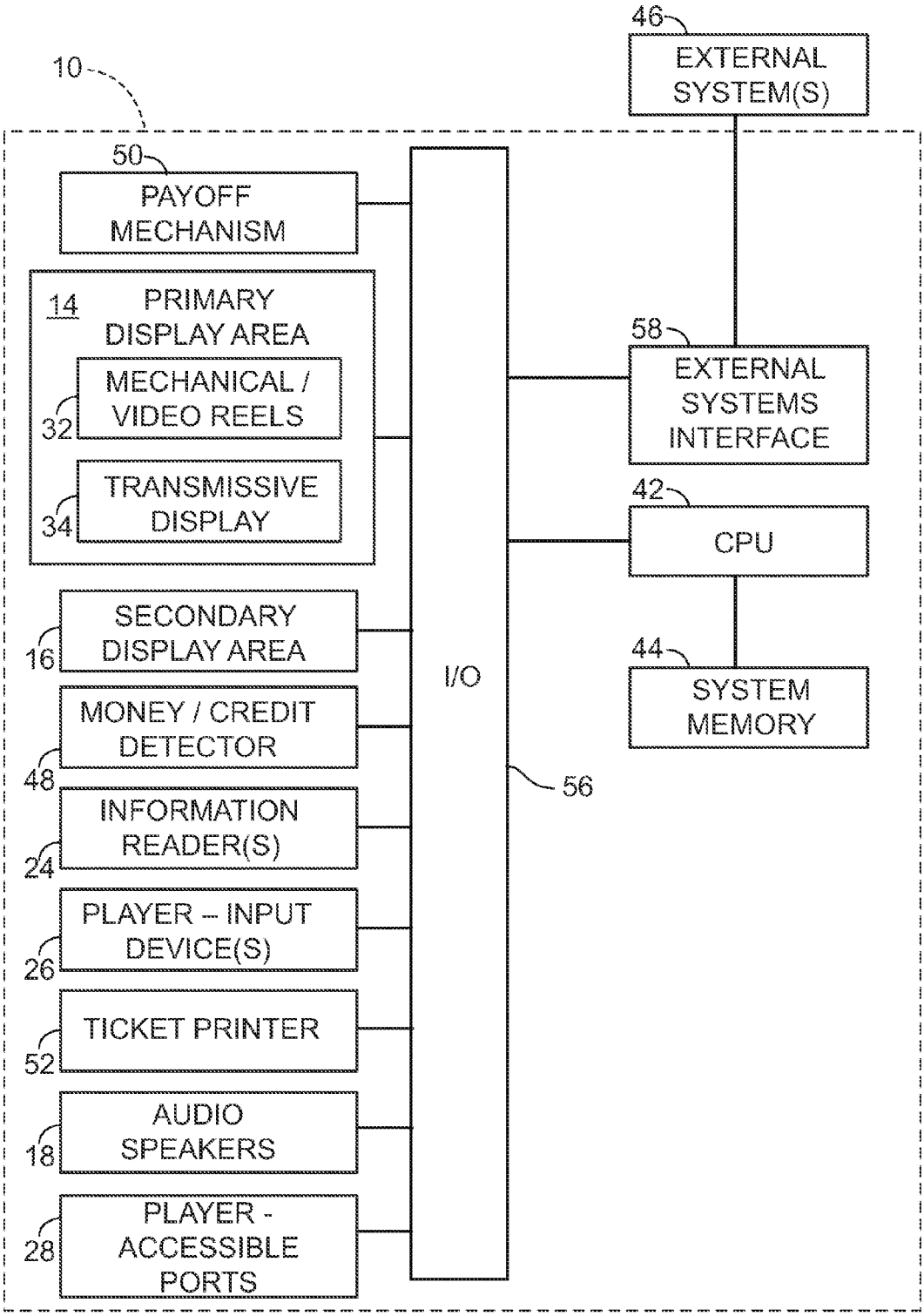
FIG. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game (s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10 bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
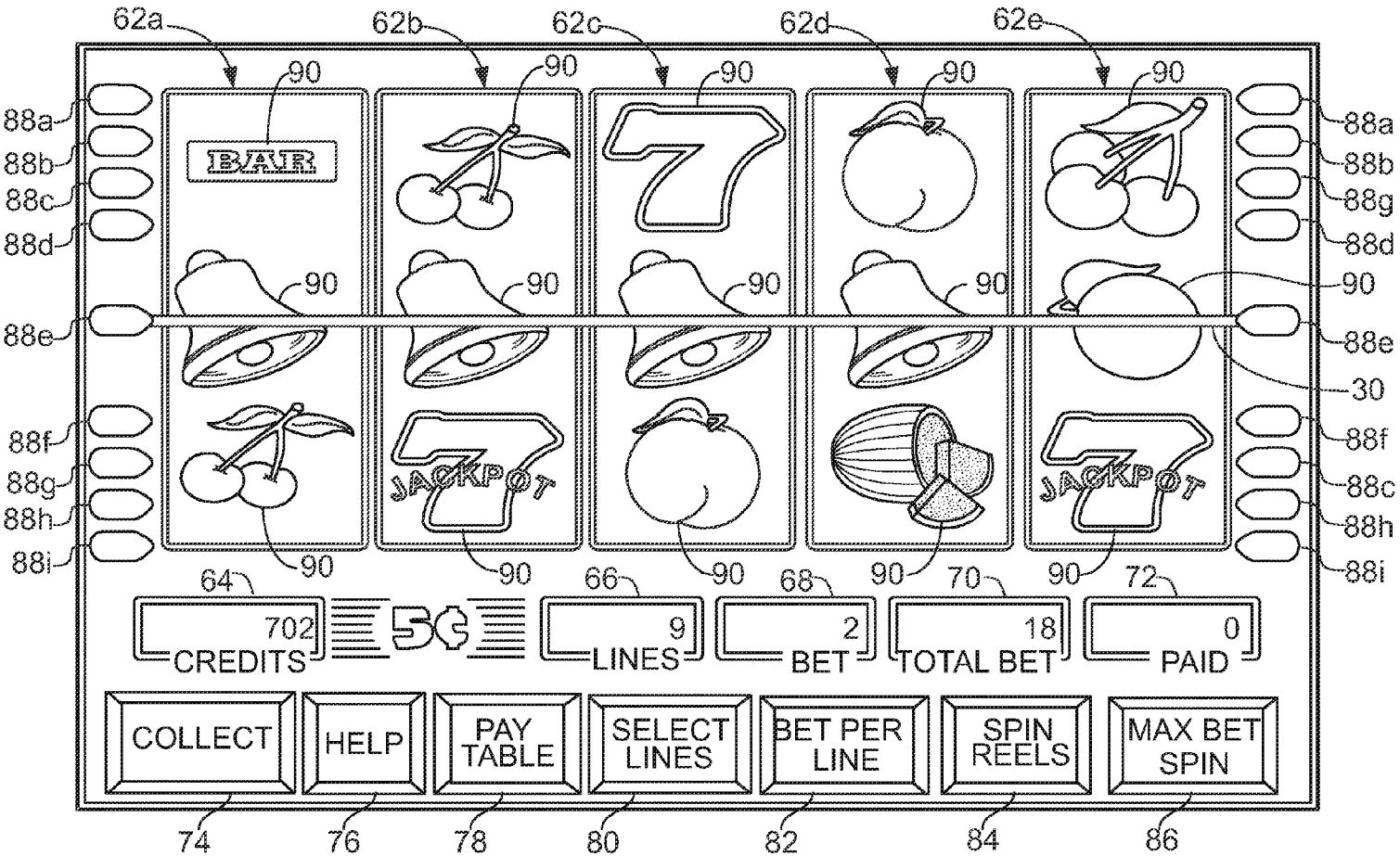
FIG. 3 PRIOR ART
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
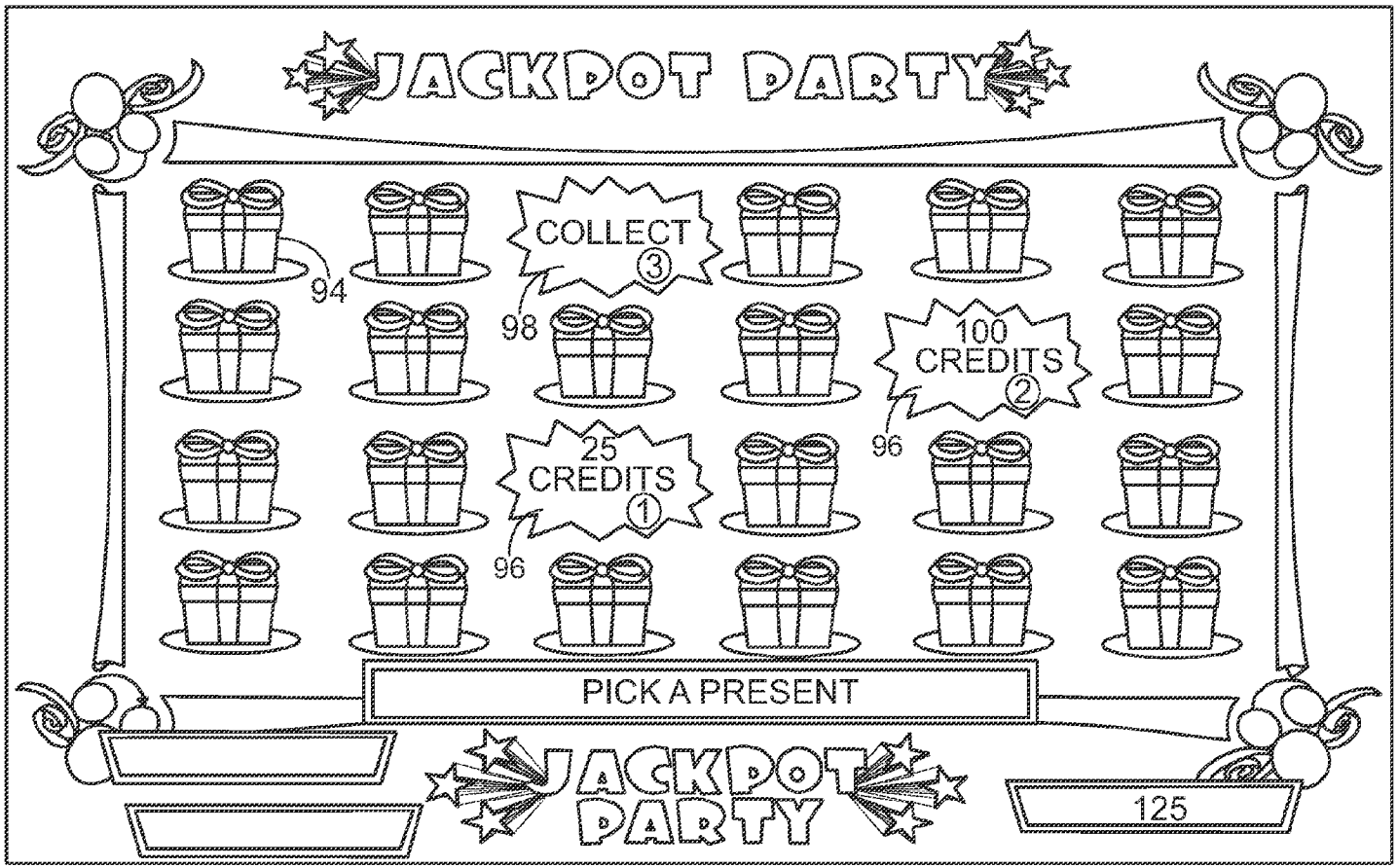
FIG.4 PRIOR ART
FIG. 4 is an image of a bonus-game screen of a wagering game that may be displayed on a gaming terminal, according to an embodiment of the present invention.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
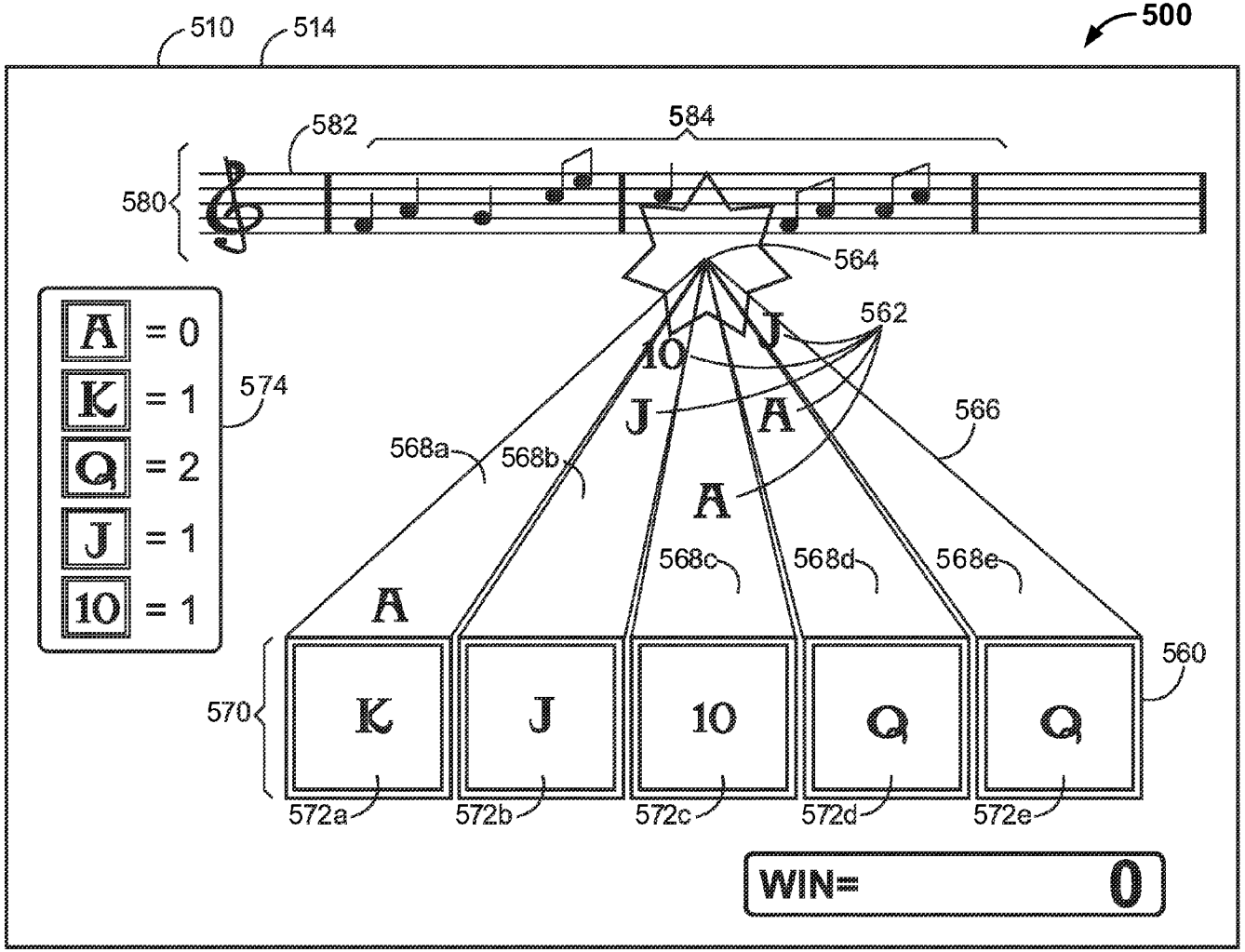
FIG. 5 is a screen shot of a wagering game having dynamic symbol generation.

Turning now to FIG. 5, a primary wagering game 560 is displayed on a primary display 514 of a gaming terminal 510 of a gaming system 500. The primary wagering game 560 includes a display of a plurality of symbols 562, which in an embodiment are randomly generated and displayed as described herein. The symbols 562 are generated from at least one symbol generation point 564 and travel down a symbol path 566 to an evaluation location 570. The symbol path 566 may comprise one or more subpaths 568*a,b,c,d,e* across which generated symbols 562 traverse to reach the evaluation location 570. Similarly, the evaluation location 570 may comprise a plurality of evaluation positions 572*a,b,c,d,e* where the symbols 562 stop for at least some period of time during which the combination of symbols 562 in the evaluation location 570 are evaluated for winning outcomes, or winning combinations of symbols 562. If a winning outcome occurs in the evaluation location 570, the player is awarded a corresponding award in accordance with one or more pay tables of the gaming system 500. The wagering game 560 includes a symbol status chart 574 which displays the number of occurrences of each symbol 562 in the evaluation location 570, as described further herein.

The primary display 514 further includes a music display 580, which in this embodiment comprises musical notes 584 along a music staff 582 appearing across the top of the primary display 514. The music display 580 provides a graphical depiction which corresponds to one or more pieces of music being played on an appropriate audio system of the gaming terminal 510. For example, the gaming terminal 510 may include speakers or headphones as described herein with reference to FIGS. 1*a* and 1*b*. Thus, as the musical compositions are played on such audio system, the music display 580 provides a graphical presentation of such audio performances. In one embodiment, for example, the music staff 582 and notes 584 display the music being played, and are animated so as to move, refresh or scroll as the music performance continues to play. Moreover, the graphical animation of the music display 580 may be choreographed or synchronized such that the notes 584 and music staff 582 animate, update, and scroll in pace with the music, the beat of the music, and/or the notes being played therein. In the embodiment shown in the FIGURES, the musical notes 584 scroll right to left across the musical staff 582 in pace with the song or musical composition being played.

In the embodiment shown in FIG. 5, symbols 562 landing in the evaluation location 570 are evaluated for winning combinations, which in this embodiment comprises three or more like symbols 562 being simultaneously presented in the evaluation location 570. In this embodiment, winning combinations are "scatter pays", meaning that the three or more like symbols 562 need not be aligned in a certain order, orientation or configuration. A scatter pay is a winning combination if a requisite number of like symbols 562 appear in the evaluation location 570 without regard to where such like symbols 562 are positioned. In other embodiments, winning combinations may be "line pays" signifying that in order to constitute a winning combination, the symbols 562 must be aligned in a certain qualifying order or orientation, for example three like symbols being aligned left to right, occupying the first through third evaluation positions 572*a,b,c*. Other criteria for evaluating winning combinations of symbols 562 may be employed as well.

As seen in FIG. 5, symbols 562 travelling down the symbol path 566 arrive at the evaluation location 570 and replace symbols 562 occupying the various positions 572 of the evaluation location 570 to create new combinations of symbols 562. In some embodiments, such as the embodiment shown in the FIGURES, the various subpaths 568*a,b,c,d,e* of the symbol path 566 are associated with, paired with, or assigned to the various evaluation positions 572*a,b,c,d,e* of the evaluation location 570. Thus, a first symbol subpath 568*a* is associated with a first evaluation position 572*a* such that symbols 562 generated and assigned to the first symbol subpath 568*a* will all travel to the first evaluation position 572*a*. Similarly, symbols 562 generated and assigned to a second symbol subpath 568*b* will all travel to a second evaluation position 572*b*. The same is true for the remaining subpaths 568*c,d,e* and evaluation positions 572*c,d,e*.

In this way, as a symbol 562 appears on the display 514 travelling along one of the subpaths 568, a player is easily able to understand and comprehend the evaluation location 572 that the symbol 562 is travelling to, such that the potential of creating a winning combination upon arrival to the evaluation location 570 is heightened. This provides anticipation and excitement during play of the wagering game 560, and allows a player to "follow along" as the symbols 562 which are being generated are sent to the various destinations. The symbol status chart 574 further assists the player by displaying the number of each type of symbol 562 currently in the evaluation location 570. The player knows that when the number of one type of symbol 562 reaches three (or more) a winning combination has occurred and a corresponding award will be provided. Thus, the symbol status chart 574 is dynamic and constantly updated as replacement symbols 562 arrive and replace prior symbols 562 located in the evaluation location 570.

In FIG. 5, five symbols 562 occupy the evaluation locations 572, which at this point in the game play are a "K" symbol, a "J" symbol, a "10" symbol, a "Q" symbol, and a "Q" symbol. In this embodiment, the set of symbols 562 used in the game are displayed in the symbol status chart 574, and includes the A, K, Q, J, and 10 symbols. The particular combination of symbols 562 shown in FIG. 5 does not constitute a winning combination of symbols, and thus a win meter on the bottom of the display 514 continues to display zero ("0") credits won. Moreover, the symbol status chart 574 indicates the number of occurrences of each type of symbol 562 currently located in the evaluation location 570. The evaluation location 570 includes one occurrence each of the K, J, and 10 symbols, zero occurrences of the A symbol, and two occurrences of the Q symbol. Thus, the symbol status chart 574 reflects those numbers of occurrences. Because no symbol 562 in the chart 574 exceeds two ("2") occurrences, no winning combinations exist.

At that same time, other replacement symbols 562 are traveling down the symbol path 566 toward the evaluation location. The replacement symbols 562 include an "A" symbol (on the first subpath 568*a*), a "J" symbol and a "10" symbol (on the second subpath 568*b*), an "A" symbol (on the third subpath 568*c*), an "A" symbol (on the fourth subpath 568*d*), and a "J" symbol (on the fifth subpath 568*e*). Each such replacement symbol 562 is travelling down its assigned subpath 568 from the generation point 564 toward its assigned evaluation position 572 in the evaluation location 570. In an embodiment, the replacement symbols 562 travelling down the symbol path 566 travel at the same speed, such that symbols 562 closer to the generation point 564 arrive after those closer to the evaluation location 570. Thus, in FIG. 5, a player can visually distinguish that the "A" symbol on the first subpath 568*a* will arrive first, the "A" symbol on the third subpath 568*c* will arrive next, the "J" symbol on the second subpath will arrive next 568*b*, and so on. The replacement symbols 562 may also increase in size as seen in FIG. 5 to emphasize their movement to the "front" of the display in the perspective view of the wagering game 560 shown.

Figure 6:
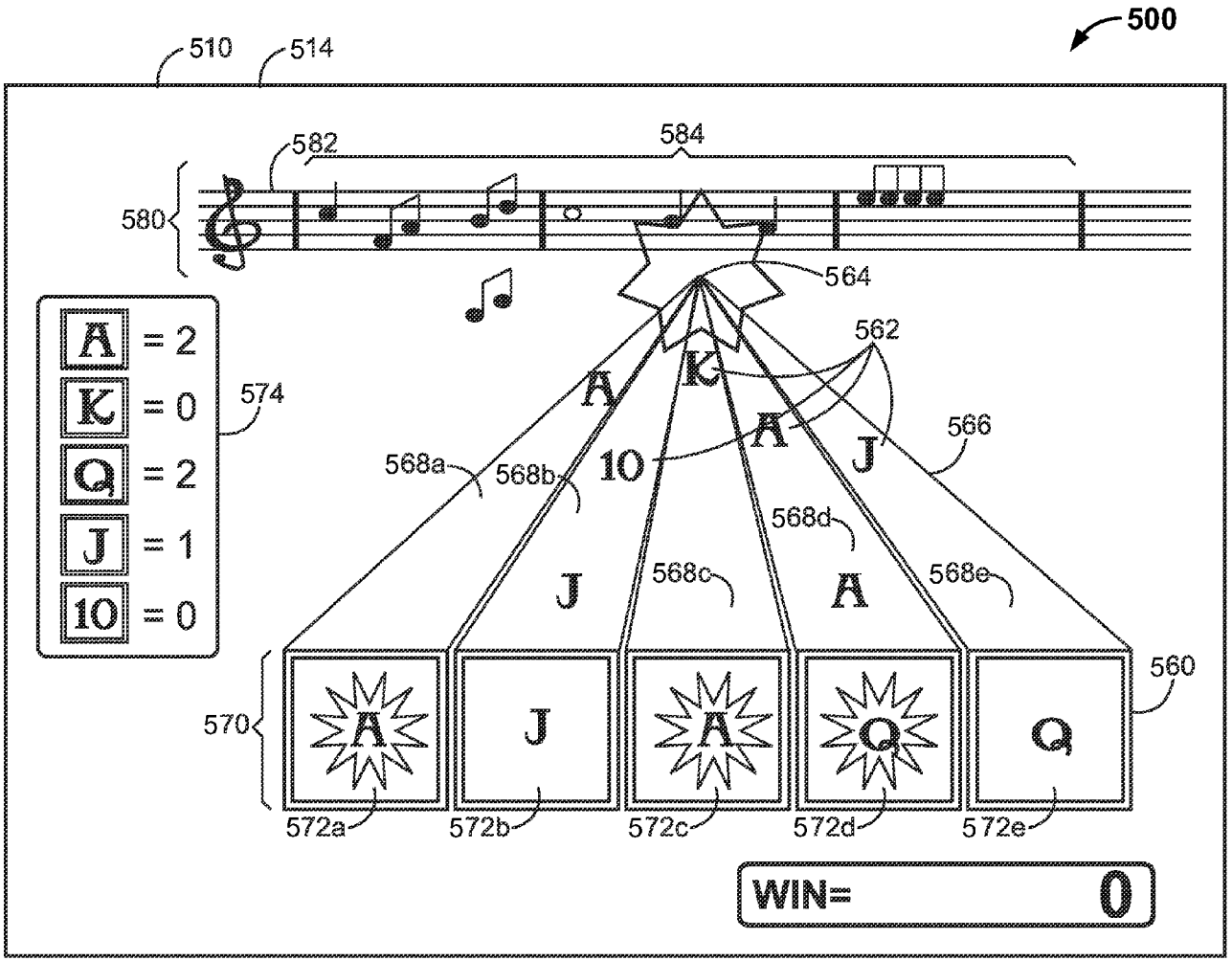
FIG. 6 is a further screen shot of the wagering game of FIG. 5, in which generated symbols replace symbols in an evaluation location.

Turning to FIG. 6, the primary display 514 is again shown now displaying a different combination of symbols 562 in the evaluation location 570. The symbols in the evaluation location 570 are changed due to the arrival of one or more replacement symbols 562 in their respective evaluation positions 572. Thus, the first to arrive is the "A" symbol in the first symbol subpath 568*a*, which replaces the "K" symbol in the first evaluation position 572*a* (see FIG. 5). This still does not create a winning combination and the win meter continues to reflect zero ("0") credits earned. The symbol status chart 574 is updated accordingly. Thus, because the "A" symbol has replaced the prior "K" symbol, the quantity of "A" symbols is incremented by one (from 0 to 1) while the quantity of "K" symbols is decremented by one (from 1 to 0). The other replacement symbols 562 are shown having moved further down the symbol path 566 and enlarged in size. Moreover, the music display 580 has been updated by the scrolling of the notes 584 along the music staff 582 consistent with the progression of the musical composition.

Figure 7:
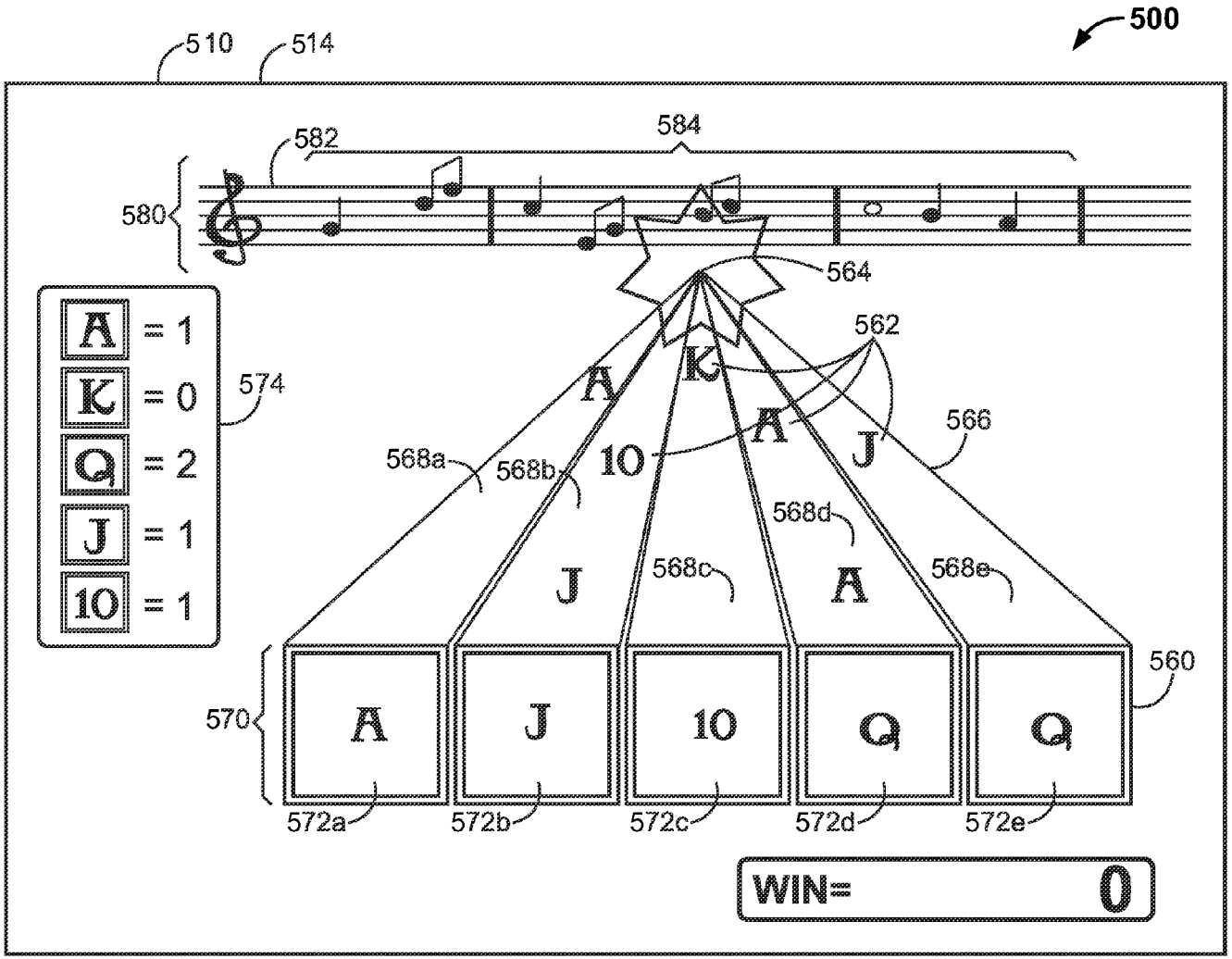
FIG. 7 is a further screen shot of the wagering game of FIG. 5, in which additional generated symbols replace symbols in an evaluation location.

In FIG. 7, the next replacement symbol 562 has arrived, which in this instance is an "A" symbol which has traveled along the third subpath 568*c*. When the "A" symbol arrives, it replaces the prior "10" symbol occupying the third evaluation position 572*c*, because as before the third subpath 568*c* is associated with the third evaluation position 572*c* such that symbols 562 travelling down that path 568*c* replace previous symbols 562 stored in that location 572*c*. Such replacement yields a new combination of symbols 562 in the evaluation location. This still does not create a winning combination and the win meter continues to reflect zero ("0") credits earned. The symbol status chart 574 is updated accordingly. Thus, because the "A" symbol has replaced the prior "10" symbol, the quantity of "A" symbols is incremented by one (from 1 to 2) while the quantity of "10" symbols is decremented by one (from 1 to 0). However, the player is close to achieving a winning combination of symbols 562 because now the evaluation location 570 includes two "A" symbols. If a third "A" symbol appeared in the evaluation location 570 (without replacing the existing two "A" symbols), a winning combination of symbols 562 would occur (three or more like symbols). Again, the other replacement symbols 562 are shown having moved further down the symbol path 566 and enlarged in size. Also, the music display 580 has been updated by the scrolling of the notes 584 along the music staff 582 consistent with the progression of the musical composition.

Figure 8:
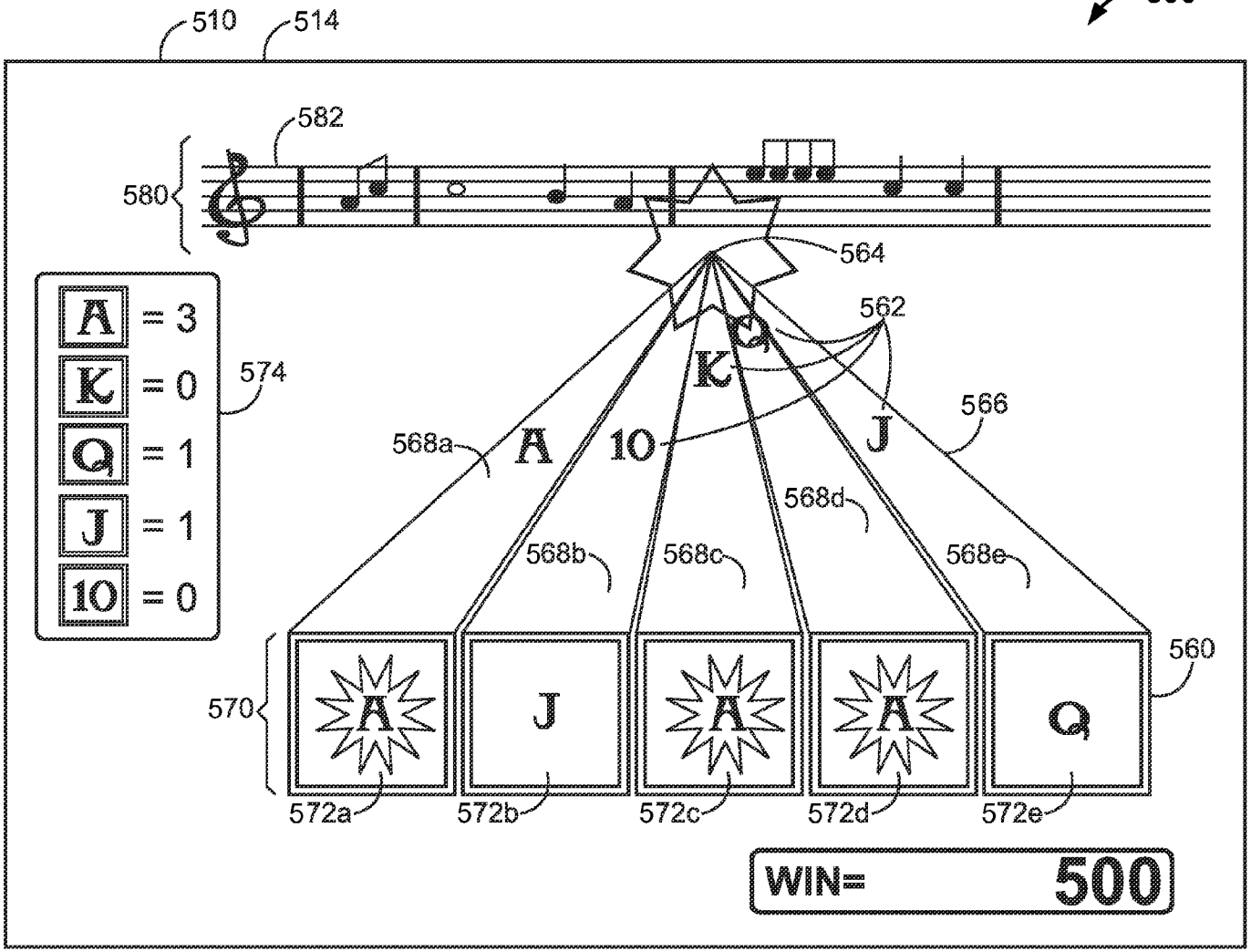
FIG. 8 is a further screen shot of the wagering game of FIG. 5, in which a winning combination of symbols is displayed and an associated award awarded.

Turning to FIG. 8, yet another replacement symbol 562 arrives along the symbol path 566. In this instance, another "A" symbol travelling on the fourth subpath 568*d* arrives to replace a "Q" symbol previously displayed in the fourth evaluation position 572*d* of the evaluation location 570. The arrival of the "A" symbol in the fourth position 572*d* creates a winning combination of symbols 562 in the evaluation location 570 (three or more like symbols, i.e. three "A" symbols). The winning combination is paid in accordance with a pay table of the gaming system 500. As seen in the win meter on the bottom of the display 514, a five hundred credit award (500) is paid to the player for the three "As" win. Upon the occurrence of a winning combination of symbols 562, a number of other visual indicators are employed to inform and highlight the win to the player. For example, as seen in FIG. 8, the three like "A" symbols 562 constituting the winning combination are highlighted and/or animated. In one embodiment, highlighting may constitute changing or enhancing the color of a symbol 562, highlighting a border of the evaluation position 572, changing the size, orientation or appearance of the symbol 562, or any combination of these and other techniques to visually distinguish the symbols 562 forming the winning combination for the other non-winning symbols 562.

Another indicating technique involves the updating of the symbol status chart 574. When the winning combination of symbols 562 occurs, the chart 574 is updated to reflect that three (3) "A" symbols are present in the evaluation location 570. This signifies to the player that a winning combination of symbols 562 has occurred and draws the player's attention to the evaluation location 570. Moreover, the chart 574 may also employ one or more of the highlighting techniques described herein to visually distinguish the line or row in the chart 574 relating to the winning symbols (in this instance the "A" symbols) from the other rows in the chart 574. In addition to these techniques, the occurrence of the winning combination of symbols may be distinguished audibly by a change in the music being played through the audio system. For example, an audio exclamation may be played, the music may be intensified, sped up, played louder, or a unique "winning" sound may be layered on top of the other music being played to signify the win. Any number of changes or emphases may be used in the music to assist in advertising and announcing the winning combination occurring in the evaluation location 570.

Figure 9:
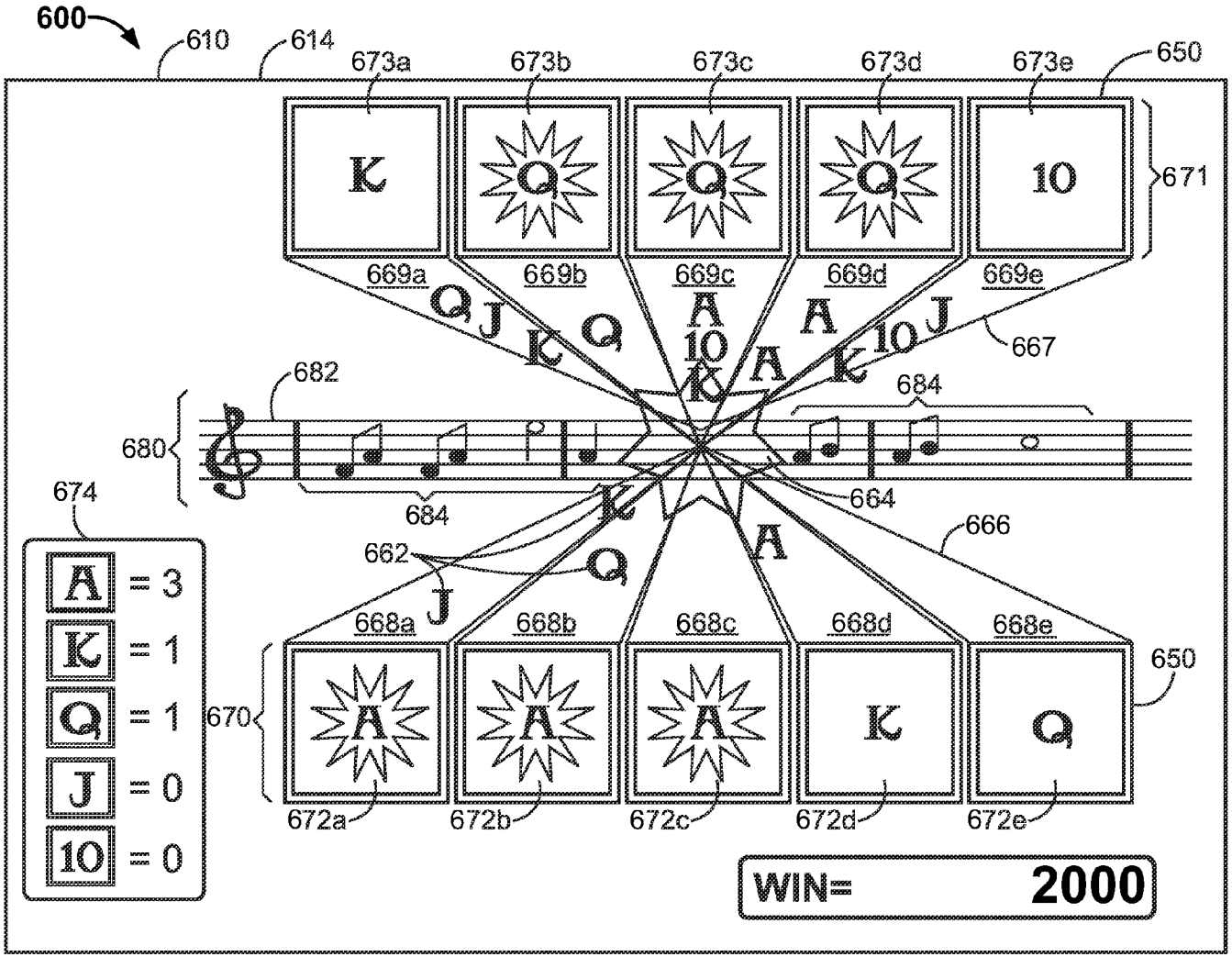
FIG. 9 is a screen shot of an embodiment of a bonus feature of the wagering game of FIG. 5.

Turning to FIG. 9, a bonus feature 650 of a wagering game is displayed on the primary display 614 of a gaming terminal 610 of a gaming system 600. The bonus feature 650 may be activated upon the occurrence of a triggering event in the underlying wagering game, for example, a certain configuration or combination of symbols appearing in the evaluation location. The bonus feature 650 may be triggered by a symbol trigger, or alternatively may be triggered by a mystery trigger. A mystery trigger refers to a triggering event which when triggered, is not readily apparent to the player why the feature was triggered. For example, the triggering event may comprise a random selection or a total wager input into the system crossing a predetermined threshold. Alternatively, the triggering event may be a symbol based triggered which is dependent on the nature and arrangement of symbols in one or more outcomes within the wagering games, as described in some of the example embodiments herein. Other triggering events may be used as well, including time based triggers, random selection, advancement to certain levels or episodes, collection of certain assets, time on device, accumulation of certain credits, etc.

Once triggered the bonus feature 650 plays out similarly to the wagering game described with reference to FIGS. 5-8. The bonus feature 650 includes a plurality of symbols paths 666,667, which convey randomly generated symbols 662 from one or more generation points 664 to a plurality of evaluation locations 670,671. As before, each symbol path 666,667 includes a plurality of subpaths 668*a-e*, 669*a-e*. Moreover, each evaluation location 670,671 includes a plurality of evaluation positions 672*a-e*, 673*a-e*. In an embodiment, each subpath 668*a-e*, 669*a-e* is associated with, paired with, or linked to an evaluation location 672*a-e*, 673*a-e* such that symbols 662 travelling along such subpath 668,669 travel predictably to their associated evaluation position 672,673. In this way, a player is able to follow the action of the bonus feature 650 by observing the movement of the symbols 662 therein.

During the bonus feature 650, the random generation of symbols 662 may be weighted or mathematically adjusted to increase a higher likelihood of winning combinations of symbols 662 occurring the evaluation locations 670,671. In this way, the bonus feature 650 may have a higher expected value than an underlying wagering game 660 in which it is triggered. Moreover, during the bonus feature 650, a high energy or fast paced musical performance may be played, along with a synchronized or choreographed generation of symbols 662 resulting in a relatively faster succession and replacement of symbols 662 in the evaluation location 670,671, thereby causing more frequent wins and awards.

As can be seen in the FIGURES, the action of the game play of the wagering games described herein can be adjusted in speed, number of symbols, etc. In one embodiment of the invention, music accompanying the display of the wagering game is randomly selected. In other embodiments, the accompanying music is player selected, or dependent upon other criteria, such as wager amount, lines played, player status, coin in, time on device, etc. It should also be understood that as symbols 562 are generated at the generation point 564 they are assigned to the various subpaths 568 of the symbol path 566 in such a fashion that they are "staggered" and travelling down the path at different intervals. This is done such that replacement symbols 562 travelling down the symbol path 566 arrive at the evaluation location 570 at different times, or intervals, and thus symbols 562 in the evaluation location 570 are replaced one at time. This creates and ongoing cyclic replacement of symbols 562 in the evaluation location 570 and provides the feeling of non-stop gaming action. In other embodiments, the symbols 562 in the evaluation location 570 may be replaced in groups, all at once, or in any other appropriate manner.

In the embodiment shown in the FIGURES, the symbols 562 travel down the symbol subpaths 568 at a rate determined by the music, for example, by the pace or "beat" of the music being played. Thus, when the musical performance being played is a fast paced song, the generation of symbols 562 increases, and the number of symbols 562 travelling down the symbol path 566 increases. This creates a synchronized or choreographed performance such that increasing music pace creates anticipation and excitement by an accompanied increase in symbol generation and replacement. In other embodiments, the rate at which symbols 562 travel down the symbol path 566 may be fixed, or may be dependent on other factors. In yet other embodiments, the symbols 562 on different subpaths 568 may travel at different rates of speeds. This creates anticipation in the form of a "guessing game" as to which symbols 562 will arrive at the evaluation location 570 first so as to replace prior symbols 562 therein and affect or change the combination of symbols, potentially creating a win.

Because the symbols 562 are randomly generated, a symbol 562 located in particular evaluation position 572 of the evaluation location 570 may be "replaced" by the same symbol 562. For example, if a "K" symbols travels down the symbol path 566 and arrives at an evaluation position 572 already occupied by a previous "K" symbol, a "K" symbol persists or remains in that position 572. In an embodiment, a "replacement" may actually visually occur (i.e. the newly arriving "K" symbol replaces the prior existing "K" symbol). In other embodiments, the prior symbol may just visually persist since the replacement symbol is the same.

Figure 10:
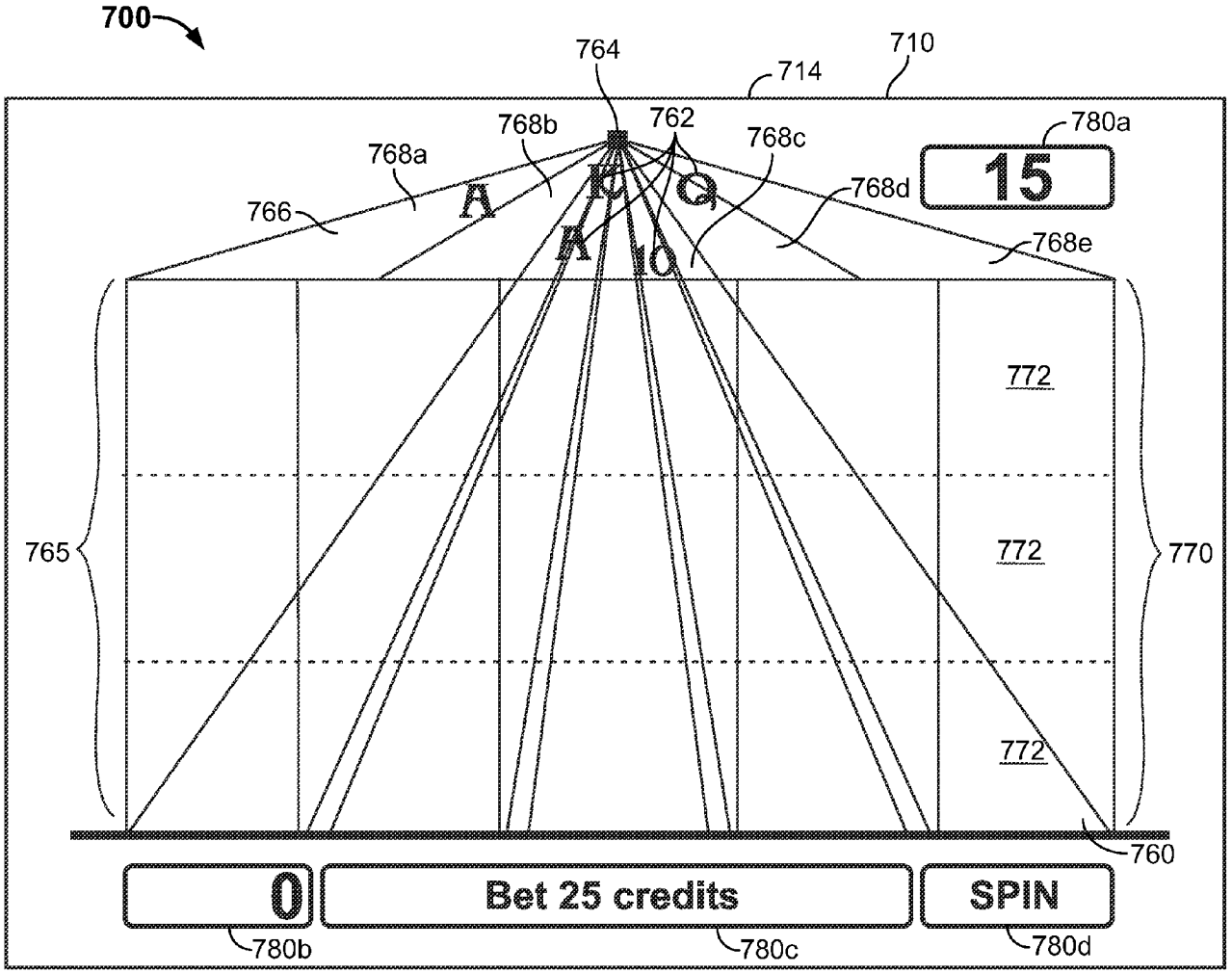
FIG. 10 is a screen shot showing the commencement of play of another embodiment of a wagering game having dynamic symbol generation, in which the evaluation location comprises a two dimensional array.

Turning to FIGS. 10-13, an alternative embodiment of a wagering game 760 having dynamic symbol generation is depicted. In FIG. 10, the wagering game 760 is displayed on a primary display 714 of a gaming terminal 710 of a gaming system 700. The primary wagering game 760 includes an array 765 which is formed by a plurality of symbols 762 occupying the positions 772 within the array 765. The array 765 comprises a plurality of rows and columns defining such symbol positions or evaluation positions 772, which in this embodiment is three rows and five columns. The various positions 772 within the array 765 may be located on reels (not shown), on other moving graphical elements, or may be fixed as shown in FIG. 10. As with other embodiments, a symbol generation point 764 is located on the primary display 714. In this embodiment, the symbol generation point 764 comprises a small square located "behind" the array 765 in a perspective view.

The primary display 714 further includes a symbol counter 780*a*, a win meter 780*b*, a bet meter 780*c*, and a Spin button 780*d*. The symbol counter 780*a* indicates to the player how many symbols 762 remain to be generated on a single play of the game 760. As seen in FIG. 10, a player is given fifteen (15) symbols 762 for a single play of the game 760 in this embodiment. In other embodiments, the player may receive greater or fewer than fifteen (15) symbols 762 for a play of the game 760. The win meter 780*b* indicates to the player the number of credits won for any winning combination of symbols 762 occurring in the array 765. Wins may be paid in accordance with one or more pay tables store in memory of the terminal 710 or system 700. The bet meter 780*c* indicates to the player the number of credits he or she is wagering on a particular play of the game 760. The Spin button 780*d*, when actuated by the player, causes a play of the wagering game 760 to commence.

In FIG. 10, the player has placed a 25 credit wager (as seen in the bet meter 780*c*), and pressed the Spin button 780*d* to commence a play of the game 760. The player is given fifteen symbols 762 which are randomly generated at the symbol generation point 764 and sent to random symbol locations within the array 765. The generated symbols 762 move from the symbol generation point 764 to their respective locations in the array 765 by travelling along a symbol path 766. In this embodiment, the symbol path 766 is shaped like a pyramid with the vertex at the symbol generation point 764 and the base comprising the four corners of the array 765. As with other embodiments, the symbol path 766 comprises a plurality of symbol sub-paths 768, each sub-path 768 corresponding with one or more evaluation positions 772 in the evaluation location 770. In this embodiment, the evaluation location 770 is the entire array 765 of symbol positions or evaluation positions 772. In other embodiment, the evaluation location 770 may be a portion or subset of the positions 772 in the array 765 (for example the middle row of symbol positions 772). Thus, in this embodiment, since the array 765 comprises three rows and five columns of positions, there are fifteen symbol positions, and hence fifteen (15) evaluation positions 772 within the evaluation location 770.

Figure 11:
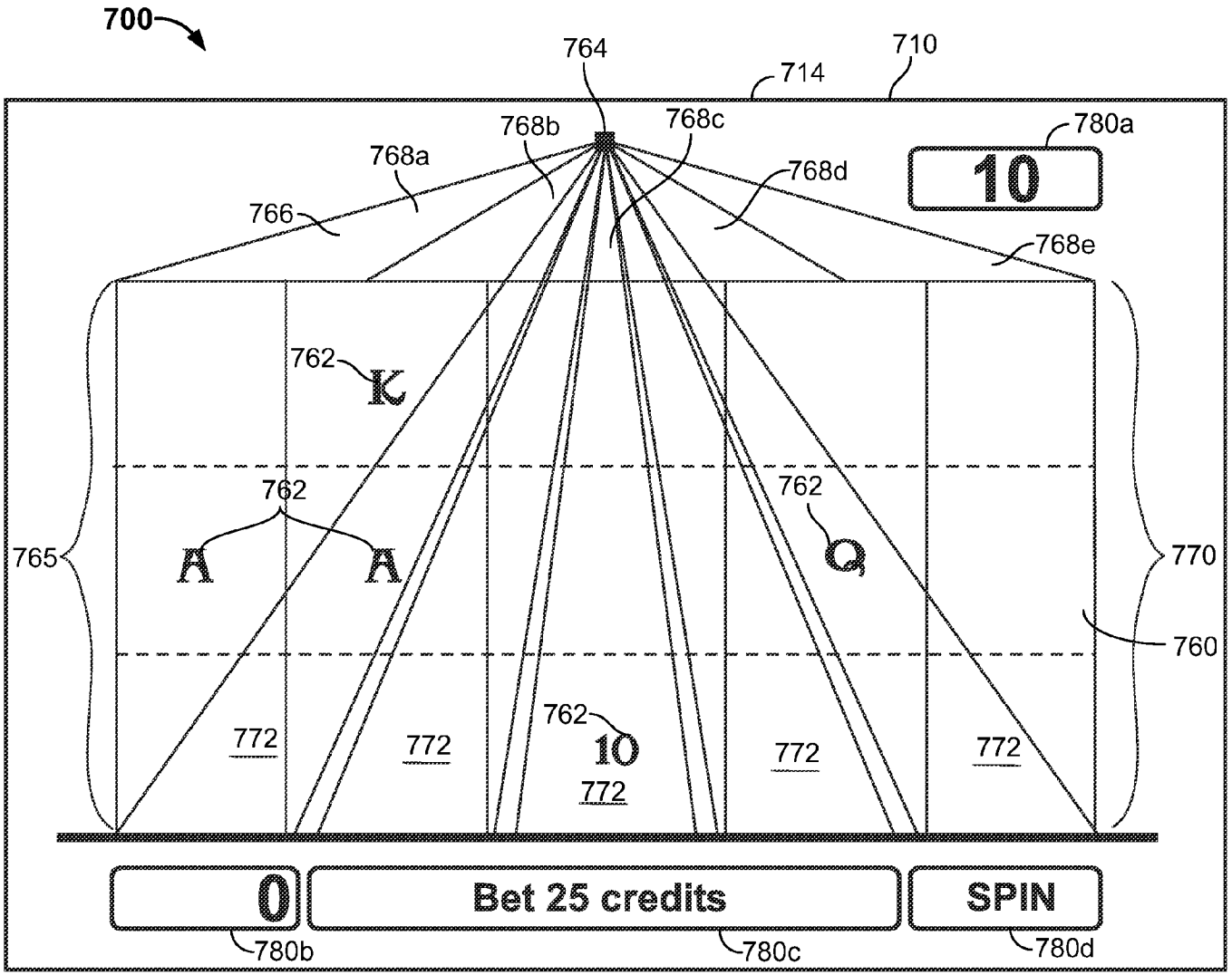
FIG. 11 is a further screen shot of the play of the wagering game of FIG. 10 in which symbols have arrived in their respective evaluation positions.

Turning to FIG. 11, the same play of the wagering game 760 from FIG. 10 is shown again as it progresses. Five (5) symbols 762 have been generated by the symbol generator 764 and have made their way along the symbol path 766 to their respective evaluation positions 772 in the evaluation location 770. Each generated symbol 762 is dispatched along one of the sub-paths 768 of the symbol path 766 to a predetermined destination or evaluation position 772 in the evaluation location 770. In other embodiments, the symbols 762 may travel in different manners, for example jumping from one sub-path to another, randomly, or in accordance with some rule set, formula, or algorithm. In FIG. 11, as the first five symbols 762 are generated, the symbol counter 780*a* is accordingly decremented by five, and now indicates ten (10) symbols 764 remaining to be generated. The symbol counter 780*a* may be decremented as symbols 762 are generated and leave the generation point 764, as they arrive in the evaluation location 770, or at any other appropriate time. Moreover, the symbols 762 may be generated one at a time, or may be generated and dispatched in groups. The symbols 762 may travel at the same rate or at different rates down the symbol path 766 arriving at the same or different times at the evaluation location 770. In FIG. 11, no winning combinations of symbols 762 have yet occurred in the evaluation location 770. Thus, the win meter 780*b* remains unchanged and continues to display zero (0).

Figure 12:
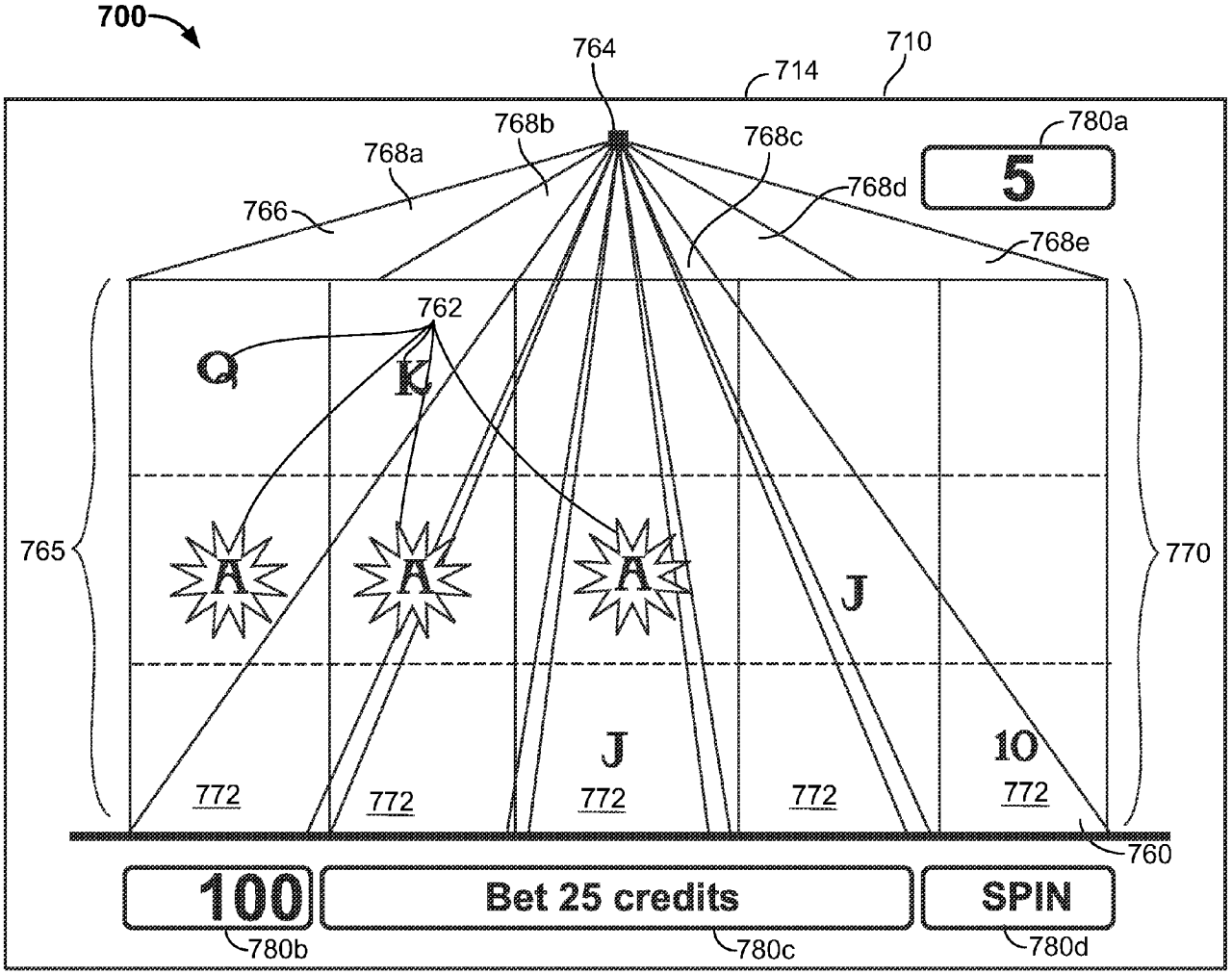
FIG. 12 is a further screen shot of the play of the wagering game of FIG. 10 in which a winning combination of symbols has occurred in the evaluation location.

In FIG. 12, the same play of the wagering game 760 from FIGS. 10 and 11 continues. Five (5) additional symbols 762 have been generated by the symbol generation point 764 and have made their way from the symbol generation point 764 to their respective evaluation locations 772 via the symbol path 766. The symbol counter 780*a* has yet again been decremented to reflect the balance of symbols 762 remaining to be generated, which is five (5). The evaluation location 770 now has eight symbols 762 located in it. This is because two of the later generated symbols 762 were sent to evaluation locations 772 previously occupied by a prior generated symbol 762, and thus replaced the prior symbol 762 in such location. For example, a Jack symbol 762 has landed in the evaluation position 772 located in the second row, fourth column, which replaces a Queen symbol 762 previously located there (see FIG. 11). Similarly, another Jack symbol 762 has landed in the evaluation position 772 located in the third row, third column, which replaces a Ten symbol 762 previously located there (see FIG. 11). Thus, even though ten (10) total symbols 762 have been generated at this point in the play of the game 760, two of the symbols 762 (the Jack symbols) have replaced prior symbols 762 in the evaluation position 770. As such, only eight symbols 762 are seen in the evaluation location 770 in FIG. 12. Thus, it should be understood that as symbols 762 are randomly generated and dispatched to the evaluation location 770, if they are sent to evaluation positions 772 occupied by other symbols 762, the prior symbol is replaced by the current symbol.

Also seen in FIG. 12 is the occurrence of a winning combination of symbols 762 in the evaluation location 770. Appearing across the middle (second) row are three Ace ("A") symbols 762 which constitute a win. Thus, the three Ace symbols 762 are highlighted to signify the win. At the same time, an award is paid to the player for the winning combination of symbols 762, in accordance with a pay table of the gaming system 700. Thus, the win meter 780*b* is updated to reflect a 100 credit win for the three Aces. However, since there are remaining symbols 762 to be generated, as seen in the symbol counter 780*a* (five symbols remaining), the play of the game 760 continues. The additional symbols 762 which have yet to be generated and dispatched to the evaluation location 770 may cause an improvement or upgrade in the player's win.

Figure 13:
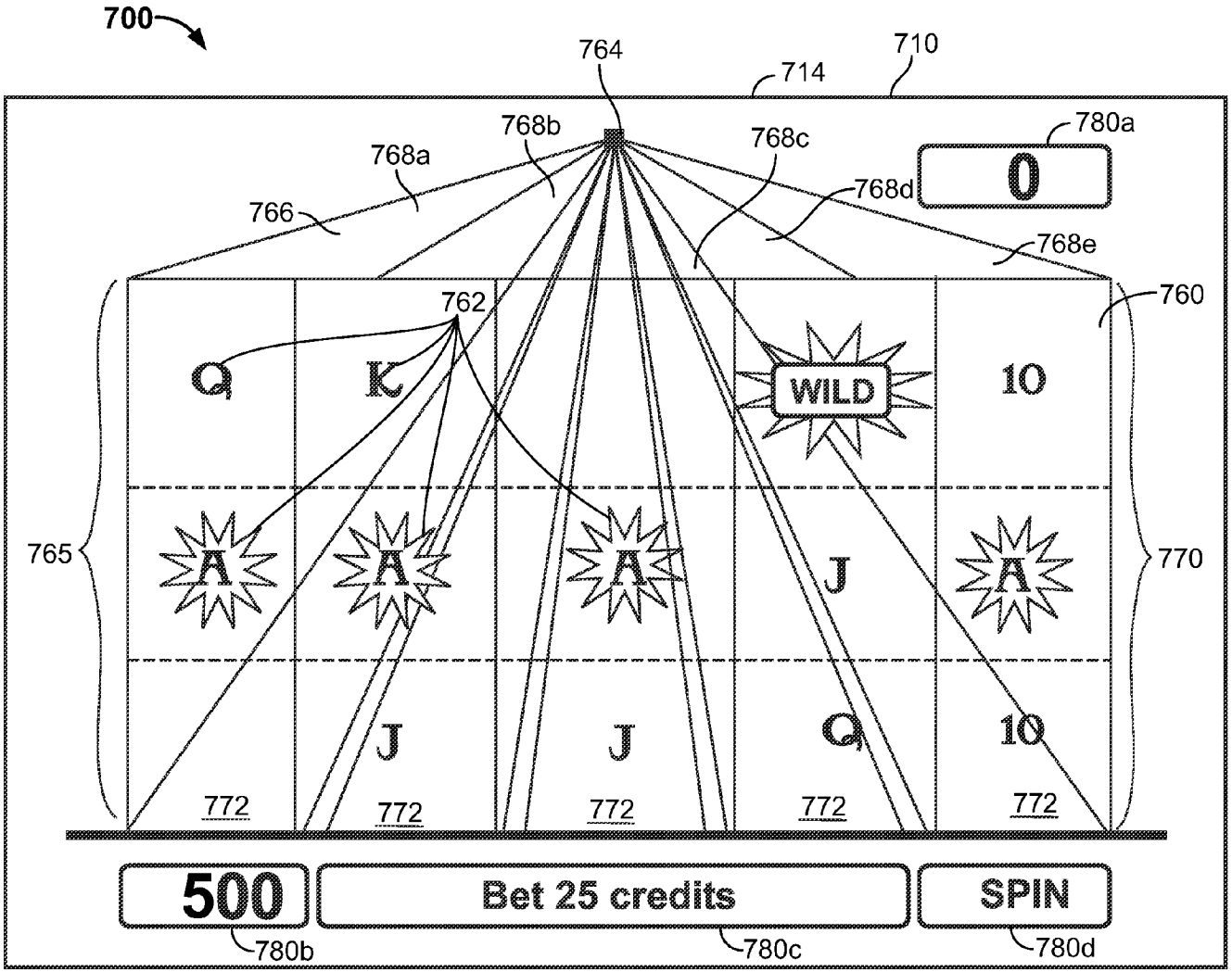
FIG. 13 is a screen shot of the conclusion of the play of the wagering game of FIG. 10 in which the winning combination of symbols from FIG. 12 has been improved.

Turning to FIG. 13, the play of the game 760 has concluded. There are no more symbols 762 to be generated, and hence the symbol counter 780*a* now reflects zero (0) indicating the end of the play of the game 760. Additional symbols 762 have been generated and have traversed from the symbol generation point 764 to their respective evaluation positions 772 in the evaluation location 770 via the symbol path 766 and their respective sub-paths 768 therein. The continued generation of symbols 762 has resulted in an improved win. The addition of a WILD symbol 762 (first row, fourth column), and another Ace ("A") symbol 762 (second row, fifth column) has expanded the previous three Ace win from FIG. 12 into a five Ace win, as seen in FIG. 13. The win is again highlighted to indicate its occurrence to the player. Additionally, the win is paid with an additional award, which in this embodiment is five hundred (500) credits. Thus, the win meter 780*b* is updated to reflect the 500 credit win from the five Ace combination of symbols 762.

Thus, after a winning combination occurs, the game play continues until all of the symbols 762 allotted to the player (and displayed in the symbol counter 780*a*) are generated and arrive in the evaluation location 770. In some instances, a winning combination of symbols 762 will be improved by the continued generation of symbols 762 as seen in FIGS. In other instances, later generated symbols 762 will destroy or remove winning combinations. For example, in FIGS. 12 and 13, if a King ("K") symbol 762 were to arrive and replace the Ace ("A") symbol 762 in the second row, first column, it would destroy the three Aces winning combination shown in FIG. 12. Hence, the arrival of additional winning symbols 762 (the WILD and the additional "A" symbol 762 in FIG. 13) would be meaningless since the first Ace would have been removed. Therefore the continued generation, dispatch and arrival of symbols 762 from the generation point 764 to the evaluation location 770 creates a dynamic game 760 in which symbols 762 are constantly moving, being evaluated and then changing.

The game 760 as shown in FIGS. 10-13 continues until all of the allocated symbols 762 to be generated (fifteen in this embodiment) have arrived in the evaluation location 770. Thus, in this embodiment, a player places a wager and in exchange gets a predetermined number of symbols 762 to be generated. In other embodiments, other mechanisms may be used to control game play. For example, the game 760 may be ongoing and continuous with the player being charged a wager for each symbol 762 generated. In another embodiment, the length of the game may be dependent on other rules. For example, game play may continue until at least one symbol 762 has been generated for each evaluation position 772. In other words, the game 760 continues until the array 765 or evaluation location 770 is full. In yet another embodiment, a player's wager buys the player a predetermined amount of time of play on the game 760 during which symbols 762 are generated at either a constant or variable rate. In another embodiment, a player may begin a play of a new game 760 while one or more symbols 762 from a previous play of the game 760 remain in the evaluation location 770. Other events may trigger additional symbols 762 to be generated as well. Other configurations are possible as well.

A symbol generation point in the various embodiments may be a location or area on the display from which symbols appear on the screen. In some embodiments, the symbol generation point is on the display outside of the area occupied by the evaluation location and the array. In other embodiments the symbol generation point may overlie the evaluation location or array, such that it appears "in front of" or "behind" the array in a perspective view. The symbol generation point may be a single point or a single discreet area (such as the "star" or "square" shaped areas in the FIGURES) from which symbols are generated. In some embodiments, a symbol generated at the generation point appears first as a very small symbol and then grows in size as it is generated and dispatched to its evaluation location.

In some alternative embodiments to the wagering games described herein, music being played may be affected by various inputs, selections, or configurations. For example, in one embodiment, the pace of the music may vary as a function of bet amount. A player placing a relatively lower bet will play a wagering game in which a relatively slower music composition is played. This will result in slower generation of symbols, slower replacement of symbols in the evaluation location, and potentially slower (and fewer) occurrences of winning combinations. On the other hand, a player placing relatively larger wagers may be permitted to play a wagering game accompanied by a higher energy or faster paced musical composition, resulting in faster symbol generation, faster symbol replacement in evaluation location, and potentially faster (and more frequent) occurrences of winning combinations.

In another embodiment, a complexity of the music performance played during the wagering game may be dependent upon wager size. For example, all players may be presented with different version of the same musical performance or song. However, a player placing a relatively lower wager may be presented with only a few portions or "tracks" of a song, while a player placing relatively higher wagers may be allowed to listen to more tracks of the song, for example as played by a full orchestra. Thus, the lower wagering player listens to a simpler or less musically complex version of the song, while a higher wagering player listens to more complex, robust, or fuller version of the song. In one embodiment, a low wagering player may listen to only a melody or lead track while a high wagering player listens to the same melody or lead track as accompanied by a plurality of other tracks. For example, the other tracks may include accompanying instruments, recordings, vocals, etc. to make the presentation more enjoyable.

In the embodiment shown, the evaluation location 570 comprises a single row (or "pay line") of symbols 562. However, in alternative embodiments, a plurality of rows of evaluation locations may be employed, having a myriad of pay lines passing through the locations. For example, a second evaluation location may include a row of symbols "above" the evaluation location in FIG. 5, such that the second evaluation location is between the first evaluation location 570 and the symbol generation point 564. As symbols 562 move down the symbol path 566 they would first enter the second evaluation location where they would be evaluated for winning combinations as described herein. When a replacement symbol 562 arrived on the same symbol subpath 568, a symbol 562 occupying an evaluation position 572 in the second evaluation location would move down or "be pushed down" to the lower or first evaluation location 570 where a separate evaluation would be undertaken for winning combinations of symbols 562 in the first evaluation location 570. Thus symbols 562 could move down the symbol path 566 and through a grid or matrix of evaluation positions comprising a plurality of rows and columns of an evaluation location 570.

In other embodiments, instead of symbols 562 being evaluated for winning combinations in an evaluation location 570, an accumulation or collection of symbols 562 may be the criteria by which awards are provided. For example, players collecting predetermined numbers of symbol 562 may be provided with certain associated awards. The symbol status chart 574 may be used to assist in tracking the collection of certain symbols 562 so a player may view and understand his progress, as well as future milestones he will need to achieve to receive the next level award.

The musical compositions being played in association with each wagering game may vary greatly. In one embodiment, the musical compositions or songs may be thematically associated with the wagering game 560 and the symbols 562 thereon. For example, a cowboy/western themed wagering game 560 may include symbols 562 such as a horse, a lasso, a six-shooter, etc., and may be displayed in association with country or western themed music compositions or songs. Moreover, branded or themed wagering games 560 may be presented with licensed music content (for example a Clint Eastwood themed western wagering game may be presented with licensed songs and music content from an associated movie in which the actor performed). It should be understood that synchronized and/or choreographed music is an optional feature and that in some embodiments, the music may not be synchronized to the symbol generation and replacement, or music may not be employed at all in other embodiments.

Wagering on the above described wagering games may be accomplished in any number of manners. In one embodiment, a player selects a wager amount and pays that wager amount for each note or beat of the music being played. In another embodiment, the wager amount is deducted for each symbol 562 generated by the generation point 564 and placed "in play." In yet another embodiment, a player may place a wager to play the wagering game 560 for a certain time period, or until a certain event occurs. In yet other embodiments, a player' wager size may determine how many evaluation positions 572 are located in the evaluation location 570. Other configurations are possible as well.

The system and methods of the present invention offer substantial benefits to players and operators alike. By displaying wagering game symbol generation as dependent upon associated music being played, a more entertaining and appealing gaming experience is provided. The synchronized or choreographed displayed provided by the present invention creates a more pronounced integration of music into the player's experience, as well as introducing a new and appealing way of presenting familiar elements such as line pays and reel symbols. By listening to entertaining music while observing the effect that such music has on symbol generation, symbol travel along the symbol path, and ultimately evaluation of winning combinations of symbols, the player is provided a new and unique gaming presentation. Other benefits are provided as well.

Each of these embodiments and obvious variations thereof is contemplated as falling within the spirit and scope of the claimed invention, which is set forth in the following claims.

What is claimed is:

1. A method of playing a wagering game for a human player, the player providing a player input to the wagering game and a wagering game outcome is determined, the method comprising the acts of:

accepting, at a player-input device, the player input and transforming the player input into an electronic signal indicative of a wager to play the wagering game;

displaying on at least one display a first plurality of symbols located in an evaluation location;

repeatedly generating, via one or more processors, a plurality of replacement symbols at a symbol generation point on the at least one display;

causing, via one or more processors, the plurality of replacement symbols to travel from the symbol generation point to the evaluation location along a symbol path;

replacing, via one or more processors, at least one of the first plurality of symbols with at least one of the replacement symbols arriving at the evaluation location; and paying an award for a winning combination of symbols in the evaluation location.

2. The method of claim 1, wherein the evaluation location comprises an array of evaluation positions.

3. The method of claim 2, wherein the array comprises a plurality of rows and columns.

4. The method of claim 1, further comprising playing a first musical composition while repeatedly generating the plurality of replacement symbols.

5. The method of claim 4, wherein a speed at which replacement symbols are generated is dependent upon one or more of a speed of the first musical composition.

6. The method of claim 4, wherein a speed at which the replacement symbols travel along the symbol path is dependent upon a speed of the first musical composition.

7. The method of claim 4, further comprising ceasing play of the first musical composition and commencing play of a second musical composition, the second musical composition having a different speed than that of the first musical composition.

8. The method of claim 7, further comprising adjusting a speed at which the replacement symbols are generated to be synchronized with a speed of the second musical composition.

9. The method of claim 1, further comprising dispatching each of the plurality of replacement symbols along one of a plurality of subpaths of the symbol path.

10. The method of claim 9, wherein each of the plurality of subpaths is associated with one of a plurality of evaluation positions of the evaluation location.

11. The method of claim 10, wherein a first replacement symbol dispatched along a first subpath of the symbol path replaces a symbol located in a first evaluation position of the evaluation location.

12. The method of claim 1, further comprising receiving a wager for each replacement symbol generated.

13. The method of claim 1, wherein the first plurality of symbols is displayed in response to receiving a wager.

14. The method of claim 13, wherein a quantity of symbols in the first plurality of symbols is dependent upon a size of the wager.

15. The method of claim 1, further comprising displaying a symbol status chart on the at least one display.

16. The method of claim 1, further comprising upon the occurrence of a triggering event, displaying a bonus feature comprising a second symbol path and a second evaluation location, wherein replacement symbols generated at the generation point travel along one of the first and second symbol paths and replace symbols located in a respective one of the first and second evaluation locations.

17. A gaming system comprising:

a wager input device;

at least one gaming terminal including at least one display; and at least one controller operative to:

(i) cause the at least one display to display a first plurality of symbols located in an evaluation location;

(ii) repeatedly generate a plurality of replacement symbols at a symbol generation point on the at least one display;

(iii) cause the plurality of replacement symbols to travel from the symbol generation point to the evaluation location along a symbol path;

(iv) replace at least one of the first plurality of symbols with at least one of the replacement symbols arriving at the evaluation location; and (v) pay an award for a winning combination of symbols in the evaluation location.

18. The gaming system of claim 17, wherein the symbol path comprises a plurality of subpaths.

19. The gaming system of claim 18, wherein the evaluation location comprises a plurality of evaluation positions, each evaluation position associated with one of the plurality of subpaths.

20. The gaming system of claim 19, wherein the evaluation positions are arranged in an array comprising a plurality of rows and columns.

21. The gaming system of claim 19, wherein the controller is further operative to dispatch each of the replacement symbols along one of the plurality of subpaths such that each dispatched symbol arrives at the evaluation location and replaces a symbol located in an evaluation position in the evaluation location associated with the subpath along which the dispatched symbol traveled.

22. The gaming system of claim 17, wherein a winning combination of symbols comprises three or more like symbols simultaneously located in the evaluation location.

23. The gaming system of claim 17, further comprising playing a song while the replacement symbols are generated, wherein a speed of the song determines a speed at which the replacement symbols are either (i) generated or (ii) moved along the symbol path.

24. A method of playing a wagering game for a human player, the player providing a player input to the wagering game and a wagering game outcome is determined, the method comprising the acts of:

receiving, from a player-input device, a player selection of a wager size selected from a plurality of available wager sizes;

displaying on at least one display a first plurality of symbols located in an evaluation location;

repeatedly generating, via one or more processors, a plurality of replacement symbols at a symbol generation point on the at least one display;

causing, via one or more processors, the plurality of replacement symbols to travel from the symbol generation point to the evaluation location along a symbol path;

replacing, via the one or more processors, at least one of the first plurality of symbols with at least one of the replacement symbols;

playing a song while the replacement symbols are generated; and paying an award for a winning combination of symbols in the evaluation location.

25. The method of claim 24, further comprising increasing a speed of the song in response to detecting an increase in the wager size selected.

26. The method of claim 24, wherein the song comprises a plurality of musical tracks.

27. The method of claim 26, further comprising increasing a number of musical tracks which are played in response to detecting an increase in the wager size selected.

28. The method of claim 26, further comprising decreasing a number of musical tracks which are played in response to detecting a decrease in the wager size selected.

29. The method of claim 26, further comprising collecting a wager for each replacement symbol generated.

* * * * *